US005511956A

United States Patent [19]

Hasegawa et al.

[11] Patent Number: 5,511,956

[45] Date of Patent: Apr. 30, 1996

[54] HIGH PRESSURE FUEL PUMP FOR INTERNAL COMBUSTION ENGINE

[75] Inventors: Hiroshi Hasegawa; Takeo Yoshida, both of Iwata, Japan

[73] Assignee: Yamaha Hatsudoki Kabushiki Kaisha, Iwata, Japan

[21] Appl. No.: 262,629

[22] Filed: Jun. 20, 1994

[30] Foreign Application Priority Data

Jun. 18, 1993 [JP] Japan ..... 5-147747

[51] Int. Cl.[6] ..... F04B 1/00

[52] U.S. Cl. ..... 417/271; 417/273; 417/364; 123/496

[58] Field of Search ..... 417/271, 273, 417/364; 123/496, 501

[56] References Cited

U.S. PATENT DOCUMENTS

| | | | |
|---|---|---|---|
| 3,119,340 | 1/1964 | Scibbe . | |
| 3,455,105 | 7/1969 | Ito et al. . | |
| 3,490,683 | 1/1970 | Kocher | 417/273 |
| 3,577,965 | 5/1971 | Sundberg . | |
| 3,690,768 | 9/1972 | Nagasawa . | |
| 4,295,798 | 10/1981 | McIntosh . | |
| 4,308,839 | 1/1982 | Hafner et al. | 123/496 |
| 4,662,825 | 5/1987 | Djordjevic | 417/273 |
| 4,944,275 | 7/1990 | Perr | 123/501 |
| 5,255,643 | 10/1993 | Mochizucki et al. | 123/179.17 |
| 5,368,451 | 11/1994 | Hammond | 417/273 |

FOREIGN PATENT DOCUMENTS

| | | |
|---|---|---|
| 0304741 | 3/1989 | European Pat. Off. . |
| 0478099 | 4/1992 | European Pat. Off. . |
| 4026013 | 2/1992 | Germany . |

OTHER PUBLICATIONS

European Search Report dated Oct. 6, 1984.

Patent Abstracts of Japan vol. 6, No. 193 (M-160) 2 Oct. 1982 & JP-A-57 099 264 (Hitachi) 19 Jun. 1982.

Patent Abstracts of Japan vol. 10, No. 372 (M-544) 11 Dec. 1986 & JP-A-61 164 062 (Honda) 24 Jul. 1986.

Patent Abstracts of Japan vol. 14, No. 388 (M-1014) 22 Aug. 1990 & JP-A-02 146 253 (Yamaha) 5 Jun. 1990.

*Primary Examiner*—Charles Freay

*Attorney, Agent, or Firm*—Knobbe, Martens, Olson & Bear

[57] ABSTRACT

A high pressure pump for an engine fuel injection system, wherein the pump has a plurality of positive displacement pumping devices that are operating so that their delivery cycles overlap and so that the instantaneous speed of the pumping devices during their delivery strokes is constant so as to minimize pressure variations in the system and avoid the necessity of having the pump being driven in synchronized relationship to the engine output shaft. This permits the use of a variable speed drive so that the pump can be driven at speed ratios depending upon engine demand and/or eliminates the necessity for positive drives to maintain synchronization. A number of embodiments showing different pump configurations are disclosed.

31 Claims, 8 Drawing Sheets

HIGH PRESSURE FUEL PUMP FOR INTERNAL COMBUSTION ENGINE

BACKGROUND OF THE INVENTION

This invention relates to a pump for a fuel injection system, and more particularly to an improve high pressure fuel injection pump.

It has been well known that the fuel efficiency, performance and emission control of an engine can be improved by use of a fuel injection system. With such systems, fuel is delivered under pressure to the engine through a fuel injector which generally includes an injection valve that is opened and closed so as to permit the fuel to be sprayed to the engine. The fuel may be introduced either to the induction system or directly into the combustion chambers of the engine.

Although this type of arrangement has a number of advantages, there are areas where performance can still further be improved. For example, it is normally the practice to supply the fuel to the fuel injectors by means of a high pressure pump. Such pumps are conventionally reciprocating type pumps and in some instances, there may be employed one pump for each fuel injector. The pumps may, however, include a common driving element. The disadvantage with this type of construction is that the output pressure of the fuel from the reciprocating pump varies during the pumping cycle. Basically, the pressure variations are approximately equal to the variations in speed of the pumping piston. These pressure variations can, therefore, cause problems in conjunction with the accurate metering of the fuel. Also, with this type of system, it has been the practice to have the injection pump operate so that its pump cycle is related to the timing of the opening of the injector valve. This compromises the pump design and also has other disadvantages.

To overcome the effect of these pressure pulses, it has been proposed to deliver the fuel from the high pressure pump to an accumulator chamber and then to the fuel injector. The use of accumulator chambers can provide some damping in the pressure variation. However, even if accumulator chambers are employed, the pressure pulses generated by the pump still can travel through the system and cause problems with accurate fuel metering.

It is, therefore, a principal object of this invention to provide an improved pump for a fuel injection system for an engine.

It is a further object of this invention to provide a fuel injection pump for an engine wherein the pressure output pulses from the pump are substantially minimized.

It is a further object of this invention to provide a multiple piston fuel injection pump for an engine wherein the design of the pump is such that pressure variations are substantially minimized during the total pump operation.

From the foregoing description, it should be apparent that the prior art type of high pressure fuel injection pump employed must be driven at a timed relationship to the engine output shaft. This requires more expensive drives, such as a positive drive provided for by either a gear transmission or a toothed belt or chain transmission.

It is, therefore, a still further object to this invention to provide a fuel injection system for an engine having a high pressure pump which can be driven so that it does not have to be maintained in timed relationship to the engine output shaft.

The fuel requirements for an engine vary in relation to factors other than merely the speed of the engine. Therefore, with prior art type of constructions that must be driven in timed relationship to the engine output shaft, the driving speed and output of the high pressure pump is always at a fixed relationship to the engine speed. However, the fuel requirements for the engine vary in response to other engine demand than merely speed. For example, under high load conditions, more fuel is required than under low load when the engine is operating at the same speed. Therefore, it has been necessary with prior art constructions to provide a pump that has a capacity that will meet the highest fuel requirements of the engine regardless of the speed at which it is driven.

Although it has been recognized that advantages can be obtained by driving the fuel pump from the engine through a speed change transmission, the variable speed pump drives previously employed all have change speed transmissions that have fixed speed ratios. The reason for this is the necessity to maintain the timed relationship between the engine output shaft and the output pulses of the pump, as aforenoted. Thus, the previously proposed pump driving systems have not been as versatile as desired and have required the use of pumps having larger capacity than is desirable for optimum conditions.

It is, therefore, a still further object of this invention to provide an improved high pressure fuel pump and driving arrangement for an internal combustion engine that permits the use of a continuously variable transmission drive.

SUMMARY OF THE INVENTION

This invention is adapted to be embodied in a pump for a fuel injection system comprising at least two positive displacement pumping devices, each movable in a cycle through a suction phase and a delivery phase. Means are provided for driving the pumping devices. The drive means and the pumping devices are interrelated so that the pumping stroke of the pumping devices overlap each other and the sum of the instantaneous speeds of the pumping devices is constant.

A further feature of this invention is adapted to be embodied in a fuel injection system for an internal combustion engine having an output shaft, a fuel injector and a high pressure fuel pump for pumping fuel to the fuel injector. A transmission drives the fuel pump from the engine output shaft without controlling the timing relationship between the engine output shaft and the fuel pump.

Another feature of the invention is also adapted to be embodied in the fuel injection system for an internal combustion engine having an output shaft, a fuel injector and a high pressure fuel pump for pumping fuel to the fuel injector. A continuously variable transmission drives the fuel pump from the engine output shaft for varying the speed at which the fuel pump is driven relative to the engine output shaft speed.

DETAILED DESCRIPTION OF THE PREFERRED EMBODIMENTS OF THE INVENTION

Figure 1:
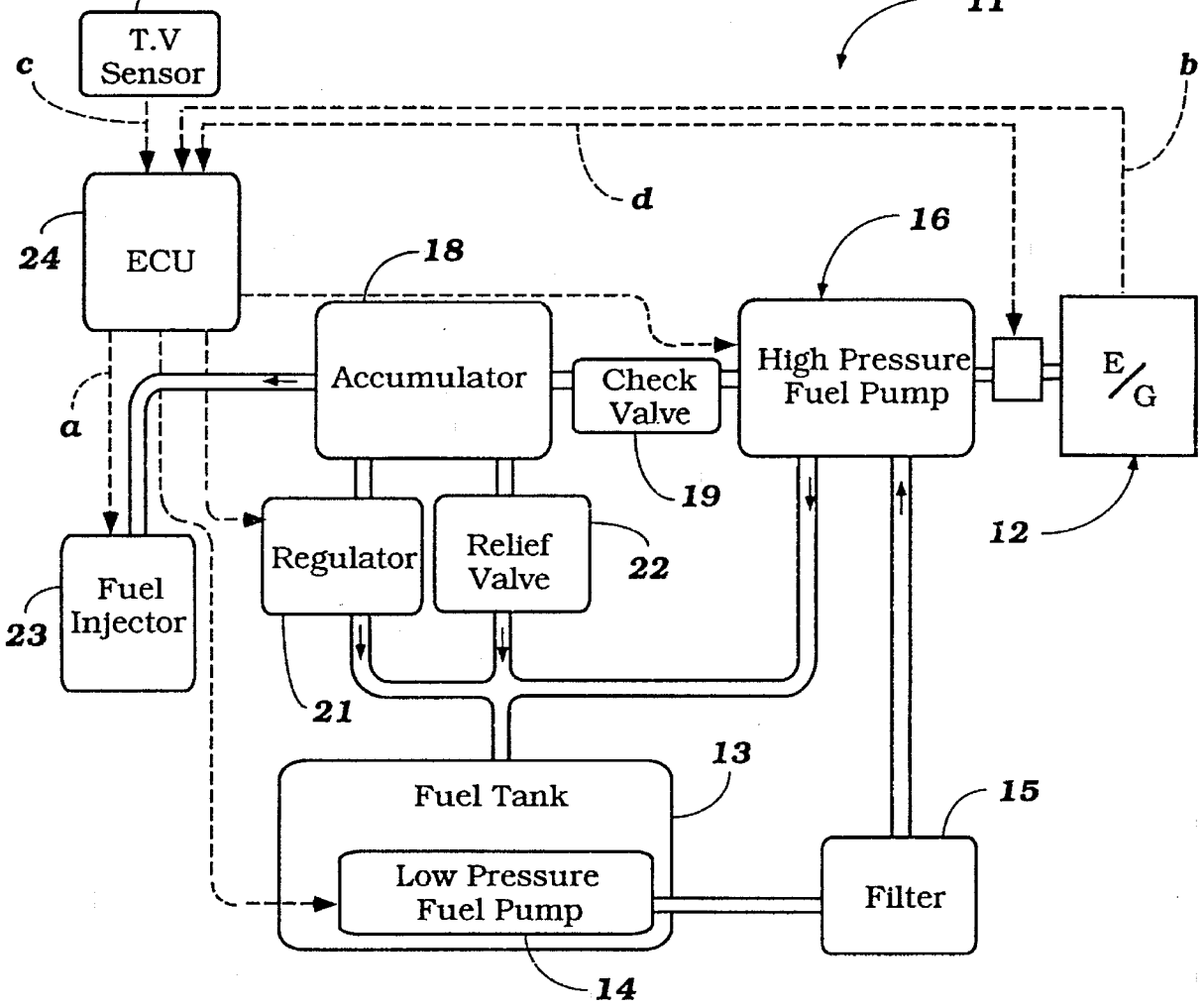
FIG. 1 is a schematic view showing a fuel injection system including a high pressure fuel injection pump constructed in accordance with an embodiment of the invention.
Figure 2:
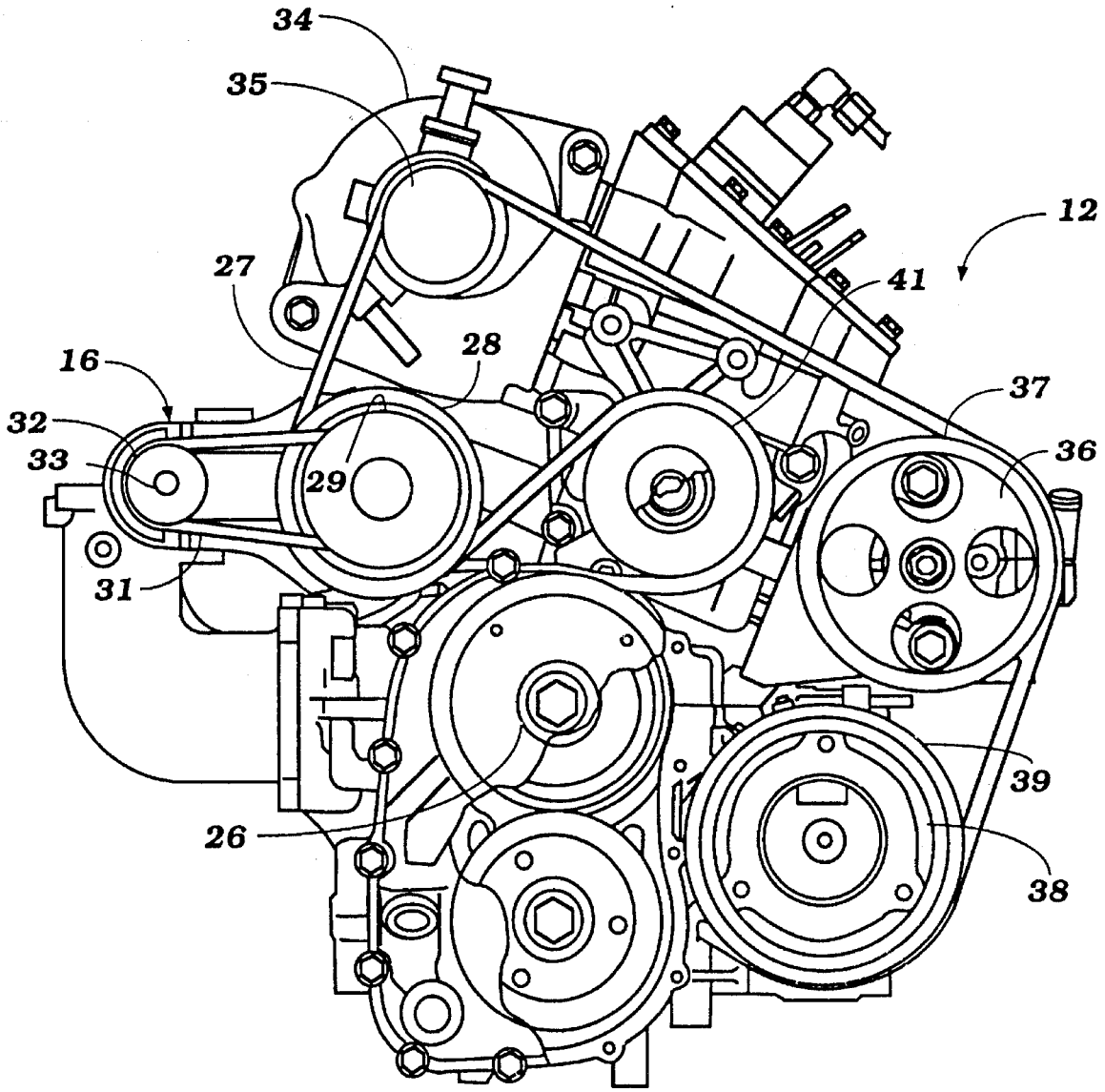
FIG. 2 is a front elevational view of an internal combustion engine having a fuel injection pump constructed in accordance with a first embodiment of the invention.

Referring now in detail to the drawings and initially to FIG. 1, a fuel injection system for an internal combustion engine having a high pressure fuel pump constructed in accordance with an embodiment of the invention is shown schematically in FIG. 1 and is indicated generally by the reference numeral 11. The system 11 and the associated internal combustion engine, shown schematically by the reference numeral 12 in FIG. 1 and in front elevational view in FIG. 2, is particularly adapted for automotive application. Although the invention is described in conjunction with such an application, it should be readily apparent to those skilled in the art, however, that the invention is capable of use in a wide variety of other applications for internal combustion engines and fuel injection systems for such engines.

Fuel for the fuel injection system is delivered from a fuel tank 13 by a low pressure pump 14 that is driven in any suitable manner and is delivered to a filter 15. The low pressure fuel pump 14 may be of the in-tank type, and is so illustrated schematically in FIG. 1.

Fuel is delivered from the filter 15 to a high pressure fuel pump, indicated generally by the reference numeral 16, and constructed in accordance with an embodiment of the invention. The high pressure fuel pump has a construction that will be described later by reference to FIGS. 3–5. The high pressure fuel pump 16 is driven from the engine 13 by a suitable transmission 17 and this drive will be described in more detail later by reference to FIG. 2.

The output from the high pressure fuel pump 16 is delivered to an accumulator chamber 18 through a conduit in which a check valve 19 is provided. The pressure in the accumulator 18 is maintained at a desired pressure by means of a pressure regulator 21 which regulates pressure in the accumulator 18 by dumping excess fuel back to the fuel tank 13 through a suitable return conduit. In addition, a relief valve 22 is provided between the accumulator chamber 18 and the fuel tank 13 and opens at a pressure higher than that of the regulator 21 to protect the system from unduly high pressures in the event of failure of the regulator.

The accumulator chamber 18 supplies fuel to fuel injectors 23 which may be of the electronically controlled type having their injection valves opened and closed by a control signal a transmitted from an ECU 24. The ECU 24 receives input signals so as to provide the desired type of fuel injection control, and these signals may be an engine speed signal b transmitted from a speed sensor associated with the engine 12 and an engine operator demand sensor c, such as a throttle valve position sensor 25. As has been noted, any type of control strategy may be employed for controlling the timing and amount of injection by the fuel injectors 23.

If desired, the drive 17 for driving the high pressure fuel pump 16 from the engine 12 may be of a variable speed type, such as one which uses a variable pulley, and in this event, control signals d may be transmitted between the drive 17 and the ECU 24 so as to vary the pump driving speed in response to engine demand. That is, when the engine is operating at high speeds or high loads, the high pressure fuel pump 16 may be driven at a faster rate of speed in relation to engine speed than when operating at low speeds and low loads. By having such a variable speed drive for the high pressure pump, it is possible to reduce the loading on the regulator 21 and relief valve 22 so as to improve the efficiency of the system.

Also, as will become apparent, since it is not necessary for the high pressure pump 16 to provide a high pressure pulse each time the injector valve is opened due to the construction of the high pressure pump 16, it is not necessary to synchronize the angular position of the high pressure pump 16 with the angular position of the output shaft of the engine 12, nor is a control of the timing of the pump plunger movements of the high pressure pump 16 necessary.

Referring now to FIG. 2, as noted, this is a front elevational view of an engine 12 having a fuel injection system constructed in accordance with an embodiment of the invention. Since the invention deals primarily with the fuel injection system, the internal details of the engine 12 need not be described and the engine can have any type of construction. However, in the illustrated embodiment, the engine 12 is of the three cylinder, in-line, spark-ignited type and operates on a two stroke crankcase compression principal.

The engine 12 has an output or crankshaft 26 that drives a number of accessories from a drive belt 27, and these accessories include a drive pulley 28 for the high pressure fuel injection pump 16. The pulley 28 is, in turn, coupled to a variable pulley mechanism 29 which drives a further drive belt 31 for driving a variable pulley 32 affixed to the input or drive shaft 33 of the high pressure fuel pump 16. The pulley 29 may have its diameter changed in any known manner, such as by a hydraulic device, and when the diameter of the driving pulley 29 is changed, the driven pulley 32 will follow it so that as the effective diameter of the driving pulley 29 is increased, the effective diameter of the driven pulley 32 will decrease so as to drive the pump drive shaft 33 at a higher speed in relation to engine speed. As previously noted, this is done so as to minimize the amount of fuel which need be bypassed back to the fuel tank under all running conditions.

The drive pulley 27 driven by the crankshaft 26 also drives an alternator 34 through a pulley 35, a power steering pump 36 through a drive pulley 37, and an air conditioning compressor 38 through a drive pulley 39. In addition, a tensioner pulley 41 is movably supported on the engine 12 for maintaining the desired tension in the drive belt 27. 0f course, the construction of the engine, except for the drive for the high pressure pump 16, may be otherwise conventional. As noted, however, since the high pressure pump 16 is operated in such a manner as to provide a substantially constant pressure output, it is not necessary to have it timed relative to the timing of the injectors of the engine or relative to a specific angular position of the crankshaft 26.

The internal details of the high pressure pump 16 will now be described by particular reference to FIG. 3, which is a cross-sectional view taken through the pump along a plane perpendicular to the axis of the pump drive shaft 33.

The pump 16 includes an outer housing, indicated generally by the reference numeral 42, which has three radially extending cylinder forming portions 43. The portions 43 are disposed at a 120° angle to each other. The cylinders 43 radiate out from a cam chamber 44 through which the pump drive shaft 33 extends. The pump drive shaft 33 is formed with an eccentric lobe 45 which cooperates with respective roller followers 46 positioned at the base of each cylinder 43 and which are journalled by tappet members 47 that are slidably supported in guide members 48 that are positioned at the lower ends of bores 49 formed in each of the cylinders 43.

The tappets 47 engage pumping plungers 51 and are connected thereto so that the pumping plungers 51 will follow the position of the roller followers 46. Coil compression springs 52 act between the tappets 47 and retainer blocks 53 that are fixed in the cylinder bores 49 in a known manner so as to urge the roller followers 46 toward engagement with the eccentric cam 45.

The pump plungers 51 are loosely guided within the retainer members 53 and are received in pumping bores 54 formed in individual cylinder members 55 that are positioned in the cylinder bores 49 at their upper ends. The cylinder members 55 are, in turn, held in place within the cylinder bores 49 by closure plugs 56 which are, in turn, held in place by head assemblies 57 which are shown in phantom in this figure. The head assemblies 57 are affixed to the cylinders 43 in any suitable manner.

Also, it should be noted that the cylinders 55 and head members 56 are provided with O-ring seals 58 so as to provide high pressure sealing.

Figure 3:
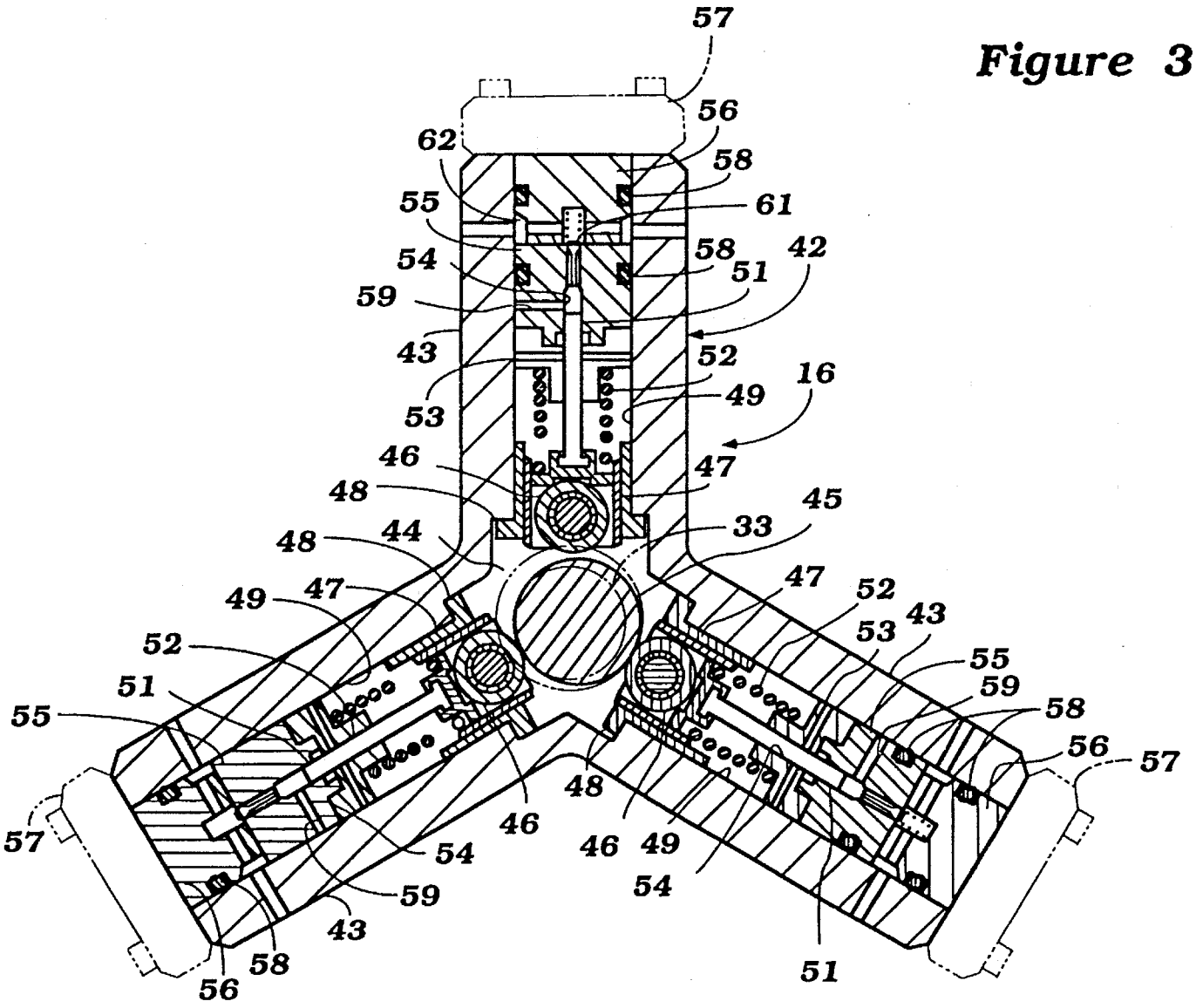
FIG. 3 is a cross-sectional view taken through the fuel injection pump of this embodiment.

It should be readily apparent that rotation of the pump drive shaft 33 will cause the eccentric cam 45 to rotate through an arc shown by the . . - line in FIG. 3, so as to effect reciprocation of the roller followers 46, tappets 47 and pumping plungers 51 within the pumping bores 54.

Fuel is delivered from the filter 15 to the individual pumping chambers 54 through inlet passages 59 that extend radially through the cylinders 55 and in which check valves are provided. This permits fuel to be drawn into the pumping chambers 54 when the pumping plungers 51 are moving downwardly within the pumping bores 54. Upon upward movement, the fuel is discharged from the pumping chambers 54 through check valves 61 mounted in the ends of the cylinders 55 to a discharge passage 62 which communications, as aforenoted, with the accumulator chamber 18 through a further check valved conduit.

Figure 4:
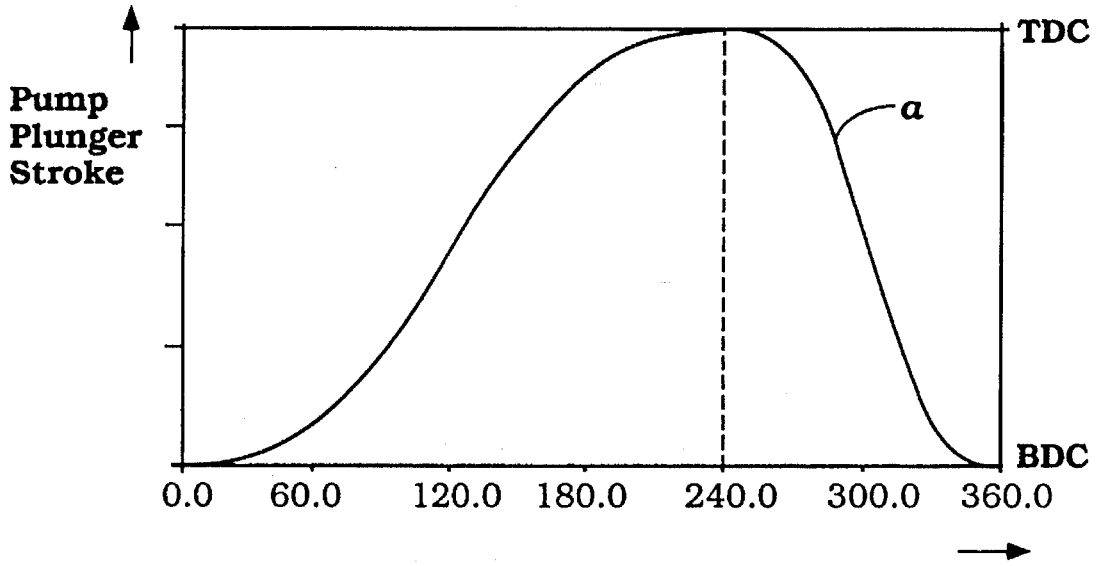
FIG. 4 is a graphical view showing how the individual plungers of the piston operate during a stroke throughout the angular rotation of the pump driving shaft of this embodiment.
Figure 5:
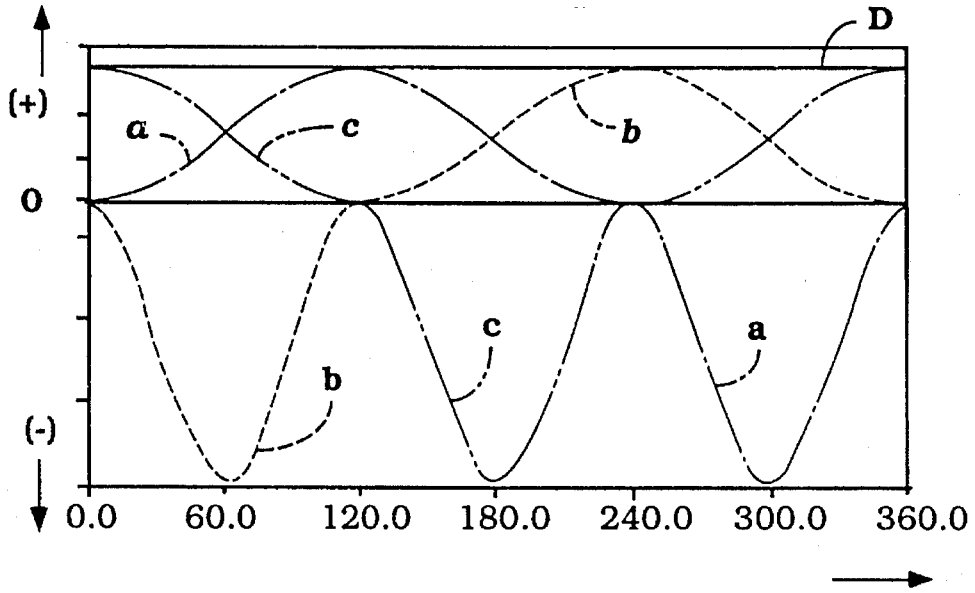
FIG. 5 is graphical view showing the instantaneous speed of the individual pump plungers of the arrangement so as to show how the pump output can be kept substantially constant during the operation.

The way in which the pump 16 operates to provide a substantially constant pressure output may be understood by reference to FIGS. 4 and 5. Referring first to FIG. 4, this is a graph showing the pump plunger position in relation to angular position of the pump drive shaft 33. The graph is typical for each of the three plungers, and the plunger illustrated is such that when the pump drive shaft 33 has rotated through 240° of rotation, it will reach its top dead-center position. Obviously, the strokes of the other pump plungers 51 will follow this same curve, but their angular position will be 120° out of phase from each other, due to the fact that the cylinders 43 are disposed at 120° to each other.

The amount of fluid displaced during the stroke of the plungers 51 per unit time will, of course, depend upon the instantaneous speed of the pump plungers. FIG. 5 is a graphical view showing the instantaneous speeds of each pump plunger 51 during a single rotation of the drive shaft 33 and explains why the pump 16 is capable of providing substantially constant pressure output, regardless of the angular position. FIG. 5 is a graphical view showing the speed of each pump plunger in relation to drive shaft angle 33 with upward movement being shown on the plus side and downward movement being shown on the minus side. As will be seen from FIG. 4, it takes 240° of revolution for the pump to reach its top dead-center position, while only 120° to reach its bottom dead-center position.

The first pump plunger to undergo a pumping stroke is indicated by the curve a in FIG. 4 and in FIG. 5, and the curve in FIG. 5 is shown by the . - line. The next in sequence pump plunger has a pump plunger stroke to crank angle curve similar to that of FIG. 4, but it is displaced 120° from it, as has been previously noted, and that pump plunger is indicated by the broken line curve b in FIG. 5.

The third pump plunger c is shown by the . . - curve in FIG. 5. Considering the first pump plunger a, as the drive shaft 33 begins its rotation and the plunger 51 begins its lift, the speed will gradually accelerate and reach maximum velocity at 120°, as may be seen also from FIG. 4, with the upward velocity falling off until the pump plunger reaches top dead-center at the 240° position. The pump plunger then moves downwardly to obtain a negative velocity, and in the next 60° of rotation, reaches its maximum downward velocity and reaches bottom dead-center at 360°.

The second plunger, considering the position in the direction of rotation of the pump drive shaft 33, will have been moving downwardly from the 0° to 120° position and then will begin to move upwardly as the cam 45 will cause its movement in this direction, and the curve b is the same as the curve a, but is displaced 120° from it. The same is true with respect to the relationship between the curve c of the third plunger relative to the curve b of the second plunger. It should also be noted that while the plunger a is accelerating, the plunger c is decelerating from top dead-center position, and hence the sum of all plunger upward velocities at any point in crankshaft rotation is the same as indicated by the line D in FIG. 5. As a result of this construction, the pressure output from the pump will be constant.

In the embodiment of the invention as thus far described, the cylinder bores with which the pumping plungers 51 cooperate are disposed at equal angles completely around the circumference of the pump driving shaft. This radial disposition of all of the cylinders gives rise to an arrangement wherein the pump driving shaft is located generally in the middle of the pump housing assembly 42. Also, with the previously described arrangement, the driving cam 45 had only a single lobe so that each pumping plunger 51 operated through a single pumping cycle during a single revolution of the pump drive shaft.

Figure 6:
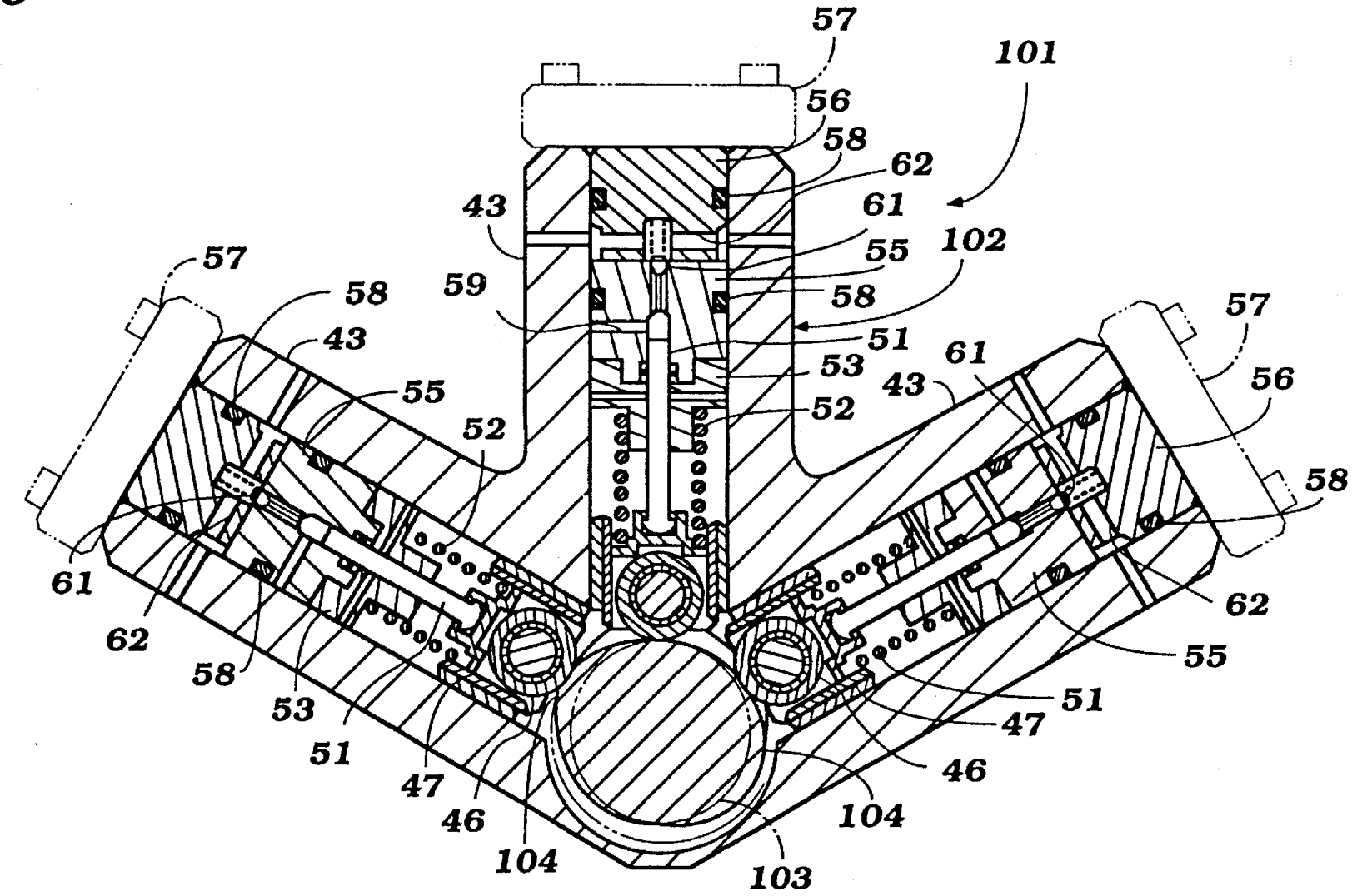
FIG. 6 is a cross-sectional view, in part similar to FIG. 3, and shows another embodiment of the invention.
Figure 7:
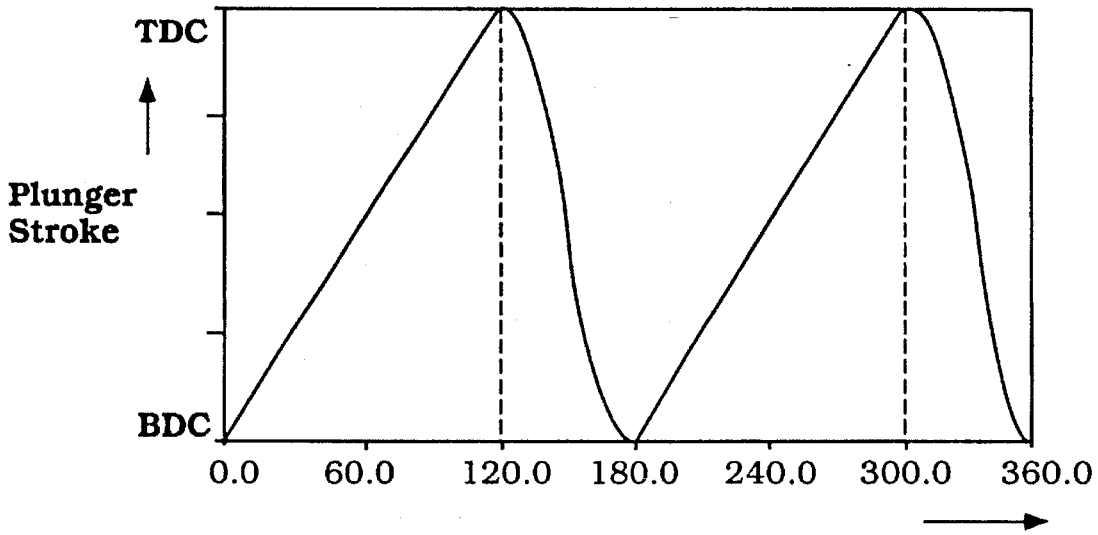
FIG. 7 is a graphical view in part similar to FIG. 4, showing the pump plunger movement during a single rotation of this embodiment.
Figure 8:
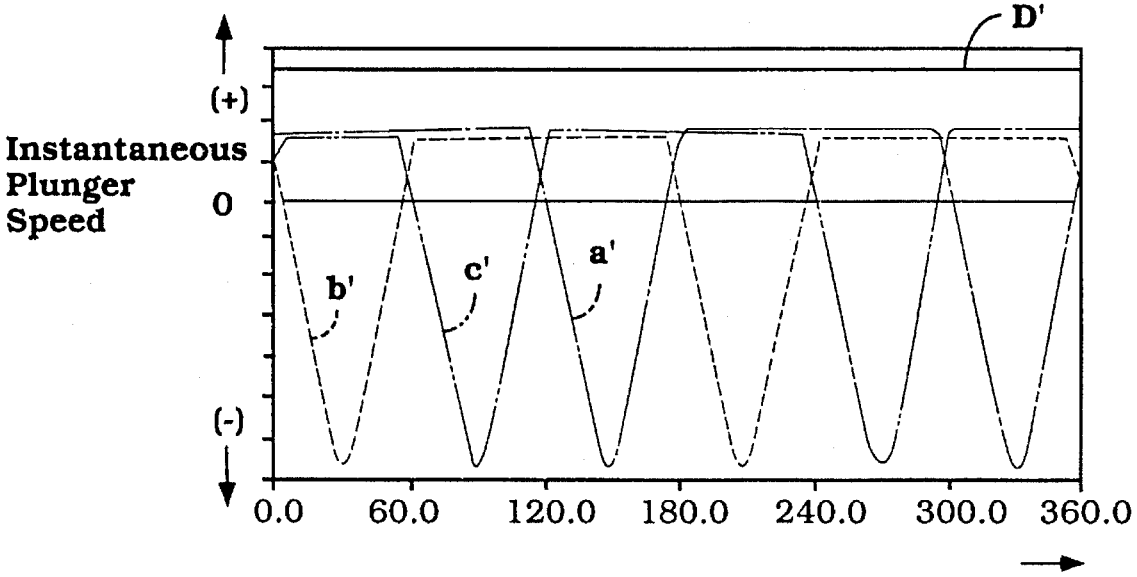
FIG. 8 is a graphical view, in part similar to FIG. 5, and shows the velocity of the individual pumping plungers during a single revolution of the drive shaft and indicating how the pump output is kept constant.

FIGS. 6–8 show another embodiment of the invention wherein the pump has a more compact construction and wherein a pair of pump driving cam lobes are provided on the pump driving shaft 33. Other than these differences the components are substantially the same. For this reason, components which are the same or substantially the same in this embodiment have been identified by the same reference numerals and only those components which have a significantly different configuration have been identified by different reference numerals.

The pump in this embodiment is indicated generally by the reference numeral 101 and has an outer housing assembly 102 in which the respective cylinders 43 are disposed. In this embodiment, the cylinders 43 are disposed at 60° rather than 120° angles from each other. In addition, a pump driving shaft 103 is provided that has a pair of lobes 104 that are disposed at 180° to each other so that during a single revolution of the pump driving shaft 103, the plungers 51 will undergo two cycles of suction and delivery strokes. In all other regards, this embodiment is the same as the previously described embodiment.

By comparing FIG. 7 of this embodiment with FIG. 4 of the previous embodiment, it will be seen that each plunger 51 undergoes two suction and delivery strokes during a single revolution of the pump driving shaft 103. The top dead-center position is reached at 120° of pump shaft rotation so that with the first pumping plunger A, the piston reaches top dead-center at 120°. However, a full cycle of operation occurs during 180° of pump drive shaft 103 revolution so that the suction stroke takes only 60° of rotation, and the second delivery occurs at 300° of pump shaft rotation. It will also be seen that the pump stroke is substantially linear up until immediately before top dead-center position and hence, the instantaneous plunger speeds are substantially constant for nearly 120° of rotation for each half cycle, or 240° during a single rotation. As a result, this pump is able to output a higher output per revolution, as shown by the line D' in FIG. 8. Also, it will be seen that each pumping plunger B1 is in a pumping cycle at the same time due to the use of the two driving cam lobes and the smaller angular displacement between the individual pumping plungers.

With the embodiments of the invention thus far described, all of the pumping plungers were disposed in a radial arrangement. It should be readily apparent that the invention can be utilized in conjunction with an arrangement wherein the pumping plungers are disposed in an in-line arrangement, or alternatively, there can be a radial arrangement with more than one plunger in each radial or angular location. That is, the purpose of the invention is to ensure that the pumping plungers of the high pressure pump are overlapping in their delivery strokes and that the sums of the instantaneous speeds of the pumping plungers during their delivery strokes is always constant. This can be achieved with a wide variety of geometric relationships.

Figure 9:
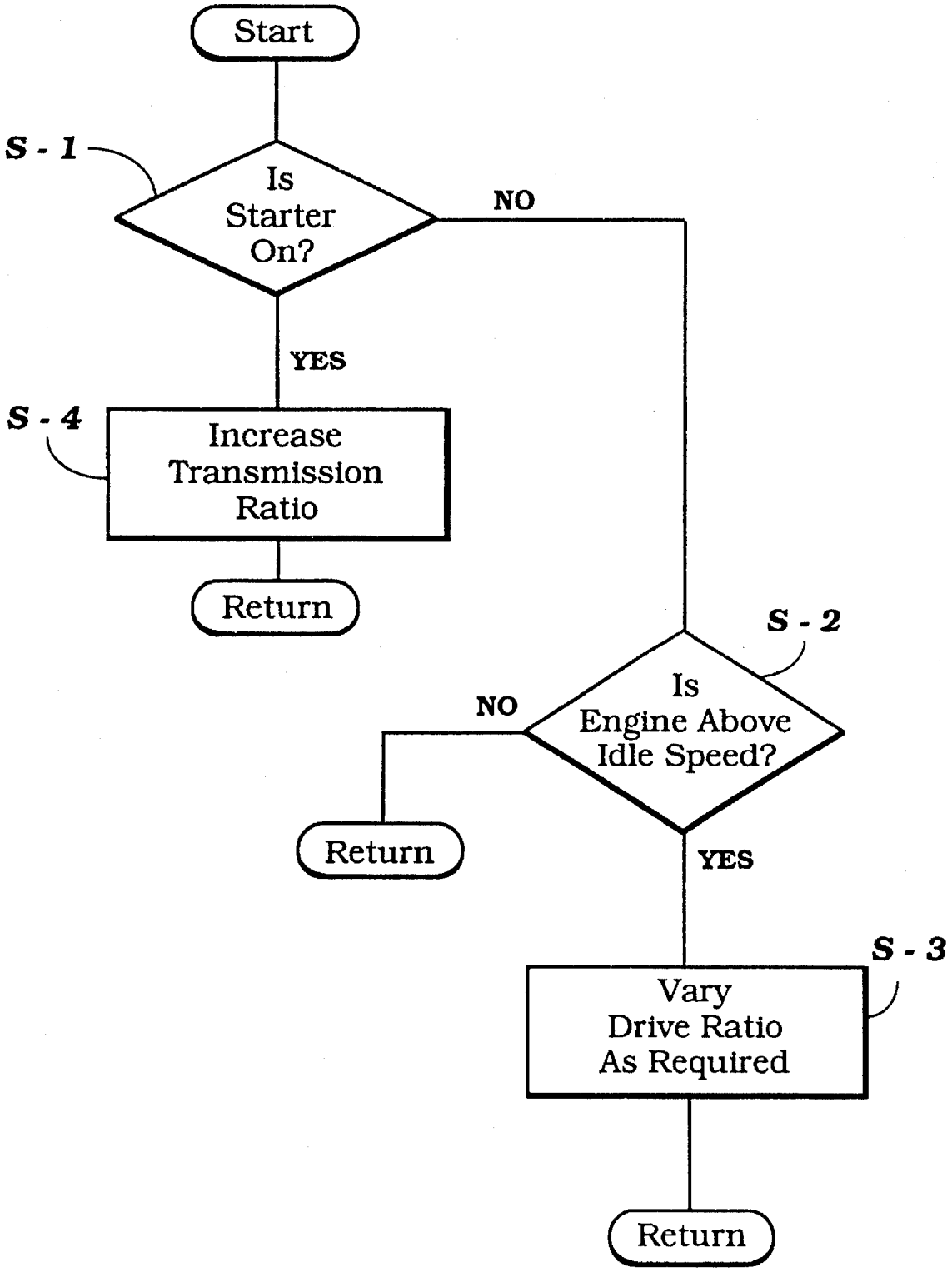
FIG. 9 is a block diagram showing a control routine that may be employed in conjunction with the engine for insuring the supply of adequate fuel for engine starting.

During starting of the engine the engine is usually driven by the starter at a speed lower than even idle speed. As a result of this, it may be that the high pressure fuel injection pump 16 will not generate sufficient pressure to ensure adequate fuel for starting. Because of the use of the continuously variable transmission 17 for driving the high pressure pump 16 from the engine output shaft, it is possible to vary the transmission ratio to drive the injection pump at a faster than normal rate during cranking so as to insure adequate fuel delivery and rapid starting. FIG. 9 shows an embodiment of control routine wherein this result can be accomplished.

Referring to FIG. 9, the program start at the step S1 so as to determine if the starter motor for the engine, which is not shown but which cooperates with the crank shaft and the engine in a well known manner, is being driven. If it is not, the program moves to the step S2 so as to establish a normal control routine. Under this control routine, it is determined if the engine is operating at idle speed or above. If the engine is not above idle speed, the program continues and repeats without changing the transmission ratio of the variable speed transmission provided by the pulley arrangement thus far described.

If, however, the engine is operating at above idle speed, then the program moves to the step S3 so as to control the drive ratio by varying the output signal d from the ECU 24 to select the appropriate transmission ratio depending upon engine speed and/or load and other factors. The program then returns after the selected speed ratio is determined.

If, however, at the step S1 it is determined that the starter of the engine is being operated, then the program moves to the step S4 wherein the ECU 24 outputs a control signal d that is effective to increase the transmission ratio of the continuously variable transmission 17 so that the high pressure fuel pump will be driven at a greater than normal speed so as to provide adequate fuel for starting. The program then returns.

Figure 10:
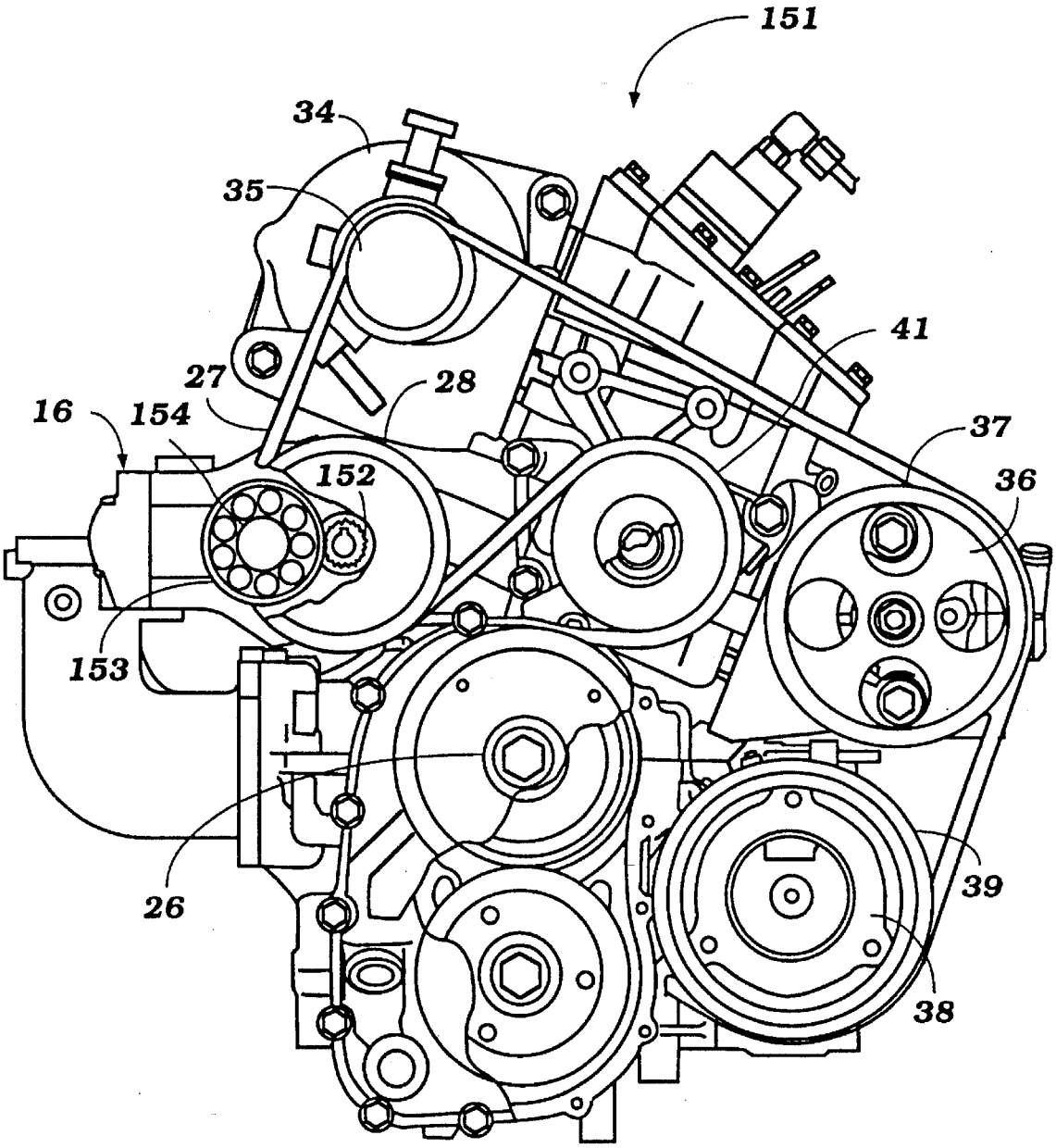
FIG. 10 is a front elevational view of an engine, in part similar to FIG. 2, and shows another embodiment of the invention.

With all of the embodiments as thus far described, the high pressure pump has been driven with a variable speed transmission from the crankshaft. However, it is also possible to use an arrangement with a constant speed drive, and FIG. 10 shows such an embodiment wherein the engine is identified generally by the reference numeral 151, but differs from the previously described arrangement of FIG. 2 only in the drive for the high pressure pump 16. For that reason, components of this embodiment which are the same as that of FIG. 2 have been identified by the same reference numeral and will not be described again, except insofar as is necessary to understand the construction and operation of this embodiment.

In this embodiment, the pump driving pulley 28 has affixed to it a small drive gear 152 which meshes with a larger driven gear 153 that is connected to the pump driving shaft 154. As a result, there will be a speed reduction between that of the pulley 28 and the pump driving shaft 154, which speed reduction can cause the cam to drive at a lower than normal speed, and this reduces mechanical losses of driving the pump 16.

It should be readily apparent that the described embodiments of the invention provide a very effective high pressure pump for a fuel injection system, wherein the pump provides a substantially constant pressure and thus reduces the likelihood of pulses being present in the injection system and resulting in efficiencies or reduction of control over the fuel injected amounts. Also, because of this arrangement, it is not necessary to synchronize the drive of the high pressure pump with the engine output shaft, and less expensive non-toothed belt drives may be employed. In addition, by using a variable speed transmission for driving the high pressure pump, it is possible to reduce the loading on relief and pressure regulator valves and provide further accuracies in fuel injection amount. Of course, the foregoing description is that of preferred embodiments of the invention, and various changes and modifications may be made without departing from the spirit and scope of the invention, as defined by the appended claims.

We claim:

1. A pump for a fuel injection system, comprising a plurality of positive displacement pumping devices for pumping fuel to a fuel delivery system supplying at least one fuel injector, each movable in a cycle through a suction phase during which fuel is drawn into said pumping device and a delivery phase during which fuel is pumped by said pumping device, drive means for driving said pumping devices, said drive means and said pumping devices being interrelated so that the pumping strokes of said pumping devices overlap each other, at least two of said pumping devices are always in a delivery phase, and the sum of the instantaneous speed of the pumping devices during the pumping strokes is constant.

2. The pump of claim 1, wherein the pumping devices comprise reciprocating plunger pumps.

3. The pump of claim 2, wherein the reciprocating plungers are driven by a cam on a camshaft.

4. The pump of claim 3, wherein each plunger is driven through more than one cycle per rotation of the camshaft.

5. The pump of claim 4, wherein the phase relation is such that the pump plungers reach their top dead-center positions at equal angle increments of rotation of the camshaft.

6. The pump of claim 3, wherein the phase relation is such that the pump plungers reach their top dead-center positions at equal angle increments of rotation of the camshaft.

7. The pump of claim 6, wherein the pump plungers are radially disposed and are all operated by a common camshaft.

8. The pump of claim 7, wherein the pump plungers are operated by the same cam lobe.

9. The pump of claim 8, wherein there are a plurality of cam lobes on the camshaft so that each pump plunger operates through a plurality of pumping strokes on a single rotation of the camshaft.

10. The pump of claim 3, wherein the relationship of the cam to the reciprocating plunger is such that the plunger moves more rapidly through its suction phase than through its delivery phase.

11. The pump of claim 1, wherein the pump is driven by an internal combustion engine to which the fuel injection system supplies fuel and wherein the pump drive shaft is not synchronized to maintain a specific angular relationship between the pump drive shaft and the engine output shaft.

12. The pump of claim 11, wherein the pump drive shaft is driven by the engine output shaft through a variable speed drive.

13. The pump of claim 12, wherein the pump drive shaft is driven at a speed ratio from the engine output shaft that increases in response to an increase in engine demand.

14. The pump of claim 13 further including means for starting the engine and means for varying the speed ratio of the variable speed drive in response to operation of the means for starting the engine.

15. The pump of claim 13 wherein the speed ratio of the variable speed drive is changed in response to engine speed.

16. The pump of claim 13 when the speed ratio and the variable speed drive is changed in response to engine load.

17. The pump of claim 12, wherein the pumping devices comprise reciprocating plunger pumps.

18. The pump of claim 17, wherein the reciprocating plungers are driven by a cam on a camshaft.

19. The pump of claim 18, wherein each plunger is driven through more than one cycle per rotation of the camshaft.

20. The pump of claim 19, wherein the phase relation is such that the pump plungers reach their top dead-center positions at equal angle increments of rotation of the camshaft.

21. The pump of claim 18, wherein the phase relation is such that the pump plungers reach their top dead-center positions at equal angle increments of rotation of the camshaft.

22. The pump of claim 21, wherein the pump plungers are radially disposed and are all operated by a common camshaft.

23. The pump of claim 22, wherein the pump plungers are operated by the same cam lobe.

24. The pump of claim 23, wherein there are a plurality of cam lobes on the camshaft so that each pump plunger operates through a plurality of pumping strokes on a single rotation of the camshaft.

25. The pump of claim 1, wherein the suction phase occurs during a smaller interval than the delivery phase so that a lesser number of pumping devices are in a suction phase at a given time than are in a delivery phase.

26. A fuel injection system for an internal combustion engine having an output shaft, a fuel injector, a high pressure positive displacement fuel pump for pumping fuel to said fuel injector, and a variable speed transmission for driving said fuel pump from said engine output shaft without controlling the timing relationship between said engine output shaft and said high pressure fuel pump.

27. A system as set forth in claim 26 wherein the transmission comprises a continuously variable transmission.

28. A system as set forth in claim 27 wherein the continuously variable transmission has its speed ratio controlled in response to engine conditions.

29. A system as set forth in claim 28 further including means for starting the engine and means for varying the speed ratio of the variable speed transmission in response to operation of the means for starting the engine.

30. A system as set forth in claim 28 wherein the speed ratio of the variable speed transmission is changed in response to engine speed.

31. A system as set forth in claim 28 wherein the speed ratio and the variable speed drive is changed in response to engine load.

* * * * *